US005626028A

United States Patent [19]

Graat et al.

[11] Patent Number: 5,626,028

[45] Date of Patent: May 6, 1997

[54] DISPLAY CASE

[75] Inventors: Kenneth T. Graat, Laguna Niguel; Randall C. Danta, Tustin, both of Calif.

[73] Assignee: Architectural Stainless, Inc., Warren, Mich.

[21] Appl. No.: 196,413

[22] Filed: Feb. 15, 1994

[51] Int. Cl.[6] ..... A47F 3/04; E04H 3/04; F25D 11/00

[52] U.S. Cl. ..... 62/252; 62/329; 312/116; 186/44

[58] Field of Search ..... 62/246, 252, 253, 62/255, 326, 329, 417; 186/38, 44; 312/116, 140, 236, 403, 407; 211/184

[56] References Cited

U.S. PATENT DOCUMENTS

| | | | |
|---|---|---|---|
| 2,279,945 | 4/1942 | Hoffman | 312/116 X |
| 2,554,610 | 5/1951 | Benson | 312/116 X |
| 2,691,872 | 10/1954 | Schaefer | 62/329 |
| 2,706,387 | 4/1955 | Swanson | 62/255 |
| 3,170,541 | 2/1965 | Werner | 186/44 |
| 3,230,732 | 1/1966 | Rustishauser et al. | 62/255 |
| 3,605,431 | 9/1971 | Carson | 62/329 X |
| 4,007,810 | 2/1977 | Weddendorf | 186/44 |
| 4,505,131 | 3/1985 | Boxall | 62/417 X |
| 4,592,209 | 6/1986 | Casanova et al. | 62/255 |
| 5,163,536 | 11/1992 | Tuhro et al. | 186/44 |

FOREIGN PATENT DOCUMENTS

| | | | |
|---|---|---|---|
| 2679020 | 1/1993 | France | 62/246 |
| 209360 | 11/1959 | Netherlands | 62/252 |

*Primary Examiner*—Christopher Kilner
*Attorney, Agent, or Firm*—Bliss McGlynn, P.C.

[57] ABSTRACT

A modular food display case system permits a particular display case arrangement to be easily customized from a basic design. A plurality of modular bed sections, which are pre-manufactured from a lightweight composite honeycomb material, are used as the basic building blocks of the customized display case, and are arranged end to end. Their lengths may be cut and angled as desired to further customize the arrangement of the customized display case. Partitions divide different temperature-controlled zones within the display case, and may be positioned anywhere along the length of the case, according to the specific arrangement and lengths of hot, cold, and dry (ambient temperature) zones employed, without regard to the ends of the case or the location of joints separating each of the bed sections.

29 Claims, 4 Drawing Sheets

DISPLAY CASE

BACKGROUND OF THE INVENTION

This invention relates to a case for displaying food in a supermarket or the like, and more particularly to a modular display case having a plurality of temperature-controlled zones or compartments, which is designed to be easily customized to a specific application.

Increasingly, in the highly competitive supermarket industry, it has become important for retailers to diversify from basic grocery products into the prepared food market, which offers higher profit margins and attracts additional traffic into the store. Such prepared foods typically include hot and cold delicatessen items, such as lunch meats, cheeses, pizza, and fried chicken; baked goods, such as breads, rolls, and pastries; and fresh salads. However, the addition of an extensive prepared food section to a supermarket requires the addition of equipment to display the food items in an attractive manner, while maintaining the temperature of hot or cold items. Accordingly, a supermarket must typically add refrigerated display cases (including freezers), hot display cases, and ambient temperature ("dry") counter space or cases, depending upon the product mix which is to be offered.

It is often desirable to display all of the prepared ready-to-eat foods which a supermarket may offer, whether cold, hot, or dry, in a contiguous area, thereby creating an integrated "food court", perhaps even including a few chairs and tables if space permits. This approach is the nest effective to draw a significant lunchtime crowd, and also best promotes the retailer as being a one-stop complete shopping center. However, a significant difficulty in designing an integrated prepared foods display area is that the existing prior art temperature-controlled food display cases, whether refrigerated or heated, are generally only available as discrete units. Therefore, if one wishes to design a display area offering cold, hot, and dry foods, it must be done by procuring an appropriate number of hot cases, cold cases, and dry cases or counter space, and simply arranging them end to end. For example, if it were desired to include a ten foot hot display compartment, a six foot counter, and an eight foot cold display compartment, this could typically only be accomplished by procuring a stock hot display case which is as close as available to ten feet long (or perhaps two five foot cases), a cold display case as close as possible to eight feet long, and a counter as close as possible to six feet long, and arranging them end to end.

Obviously, this approach is not versatile or aesthetic, and many compromises must be made in the design of a display area because of limitations in the availability of equipment. For instance, compromises may be made in the ratio or arrangement of hot, cold, and dry display space because display cases are only offered in discrete units, and may not be offered in the desired lengths. Additionally, one may not be able to contour a display area in a manner desired, because the cases and counters are only offered in linear sections. Thus, the display area can only turn a corner at the junction of two adjacent cases, and only then by angling one case with respect to the other. This approach is abrupt and awkward looking, and results in a wedge-shaped area at the front or rear of the display area which is excluded from the case interior and is unusable. Another problem is that it may be necessary to procure display cases and counters from different vendors in order to obtain the sizes desired, resulting in a significant risk that the display area will not be aesthetically uniform. Yet another problem is the discontinuity between adjacent display compartments, in that each compartment is separated from its adjacent compartments by two case end walls, both that of its own case and that of the adjacent case. Finally, if a supermarket later decides to modify its display area by changing its arrangement of display compartments or altering the ratio of hot, cold, and dry foods, it may only do so only by rearranging the existing discrete hot, cold, and dry cases or by purchasing new cases.

What is needed, therefore, is a new design approach for prepared food display cases which permits complete flexibility in arranging the hot, cold, and dry display areas, has a unitary and pleasing aesthetic appearance, is able to easily turn corners in a seamless fashion. Also needed is the ability to easily modify an installed case to a new configuration, and the ability to change the arrangement and ratio of hot, cold, and dry zones after installation, in the event that a store's product mix or marketing goals change at some later point in time.

SUMMARY OF THE INVENTION

This invention solves the problems outlined above by providing a modular display case system which permits a particular display case arrangement to be easily customized from a basic design. Using this system, a display case may be specifically tailored to a particular space and application. It may include one or more corners, of any angle, and may be configured to conform to any desired ratio and arrangement of cold, hot, and dry display space. The customized display case may be constructed off-site and transported to the site for installation, or may be constructed on site. Furthermore, regardless of the number and type of display compartments employed, the case as a whole will have a unitary and pleasing aesthetic appearance because of a uniform and attractive front panel structure which may be arranged to extend along the entire length of the case as well as an attractive glass enclosure. Most importantly, the design of the display case is such that installation is relatively easy, and modification of both the overall display case configuration as well as the arrangement and ratio of cold, hot, and dry display space, even after installation, is also relatively easy and low cost.

More particularly, a modular case is provided for displaying food or the like, which comprises abed section having a first length and having first and second ends. The case also includes a first zone (or compartment) having a second length and a second zone having a third length, wherein the first and second zones are arranged serially along a longitudinal axis of the bed section. The first and second zones are adapted for maintenance at substantially different temperatures relative to one another, i.e. hot, cold, and/or dry. A partition is located in the case for dividing the first and second zones. A key feature of the invention is that the partition may be positioned at a location along the length of the bed section axially spaced from the first and second ends of the bed section, and is adapted to be movable when modification of the lengths of the first or second zones is desired. Thus, unlike in the prior art, there is no necessity that the partitions between adjacent temperature-controlled zones be co-located with either of the ends of the bed section, but rather they may be located anywhere along the length of the bed section, thereby maximizing the ability to adapt the ratio of space devoted to a particular zone according to the need for space in that zone, dictated by the product mix robe displayed.

Typically, in a display case customized according to the principles of the invention, a plurality of bed sections are arranged end to end, such that a first end of one bed section abuts a second end of an adjacent bed section at abed joint. Even in such an arrangement, however, the partition or partitions may be positioned at a location axially spaced from the bed joint. More particularly, the location of the partition(s) is determined by design considerations related to the needs of a particular application, independently of the location of each bed joint or the length of any other zone.

Another feature of the invention is that, in most applications, the length of at least one of the bed sections employed therein is different than the length of another of the bed sections. This is because the modular bed sections, which are pre-manufactured to a standard length, may be cut to a desired length in order to customize the configuration of the case. In certain circumstances, wherein it is desired that the case turn a corner, the adjoining ends of two adjacent bed sections may be cut at predetermined opposing angles to form an angular portion of the case. The degree of angularity of the angular portion is thus directly related to the size of the predetermined opposing angles.

Yet another feature of the invention is that the completed display case typically comprises a plurality of front glass sections for enclosing the plurality of zones, which are arranged serially end to end such that the first end of one glass section abuts a second end of an adjacent glass section at a front glass joint, wherein the boundaries and lengths of each of the zones are determined independently of the location of each glass joint, as well as independently of the location of each bed joint. Therefore, again there is maximum flexibility to customize the arrangement of the temperature-controlled zones without being concerned about case construction limitations.

In another aspect of the invention, a modular case for displaying food or the like is provided which comprises a plurality of temperature controlled compartments and a plurality of partitions dividing and substantially sealing the compartments. The compartments have varying lengths, according to design considerations related to the needs of a particular application, and the partitions are movable to change the respective lengths of each compartment either during or after installation of the case, if desired. The case has a longitudinal axis and further comprises a plurality of modular bed sections arranged serially end to end and having bed joints therebetween, wherein the partitions need not be co-located with the bed joints, but rather may be located anywhere along the length of the case.

In a third aspect of the invention, a modular bed section is provided which is adapted for use in constructing a display case having a plurality of temperature-controlled zones. The bed section has a first end and a second end and is pre-manufactured to a predetermined standard length. It is adapted for combination with other similar bed sections to construct the case by attaching the bed sections in an end to end fashion along a longitudinal axis thereof. Each of the bed sections is adapted for cutting to a shorter length, if necessary, to customize the length and configuration of a particular display case.

In a fourth aspect of the invention, a method of assembling a case for displaying food or the like, having a plurality of temperature-controlled zones and a plurality of pre-manufactured modular bed sections, is disclosed. This method comprises the steps of determining the desired length of the case and procuring a sufficient number of the modular bed sections, attaching the modular bed sections in an endwise fashion, providing structure to support the bed sections, and positioning one or more partitions in the case to divide the plurality of temperature-controlled zones. The partitions are locatable anywhere along the length of the case to customize the length of each zone as desired.

In yet a fifth aspect of the invention, a method of changing the configuration of a case for displaying food or the like, is disclosed, wherein the case has a plurality of temperature-controlled compartments, includes a plurality of modular bed sections which are attached in an endwise fashion to form a desired case configuration, and has one or more partitions to divide the plurality of temperature-controlled compartments. The method includes the steps of rearranging the plurality of bed sections to create a new desired case configuration, and moving one or more of the partitions to create a new arrangement of temperature-controlled compartments, wherein the movement of the partitions may be completed without regard to the location of the joints between the bed sections.

The invention, together with additional features and advantages thereof, may best be understood by reference to the following description taken in conjunction with the accompanying illustrative drawing.

DESCRIPTION OF THE PREFERRED EMBODIMENT

Figure 1:
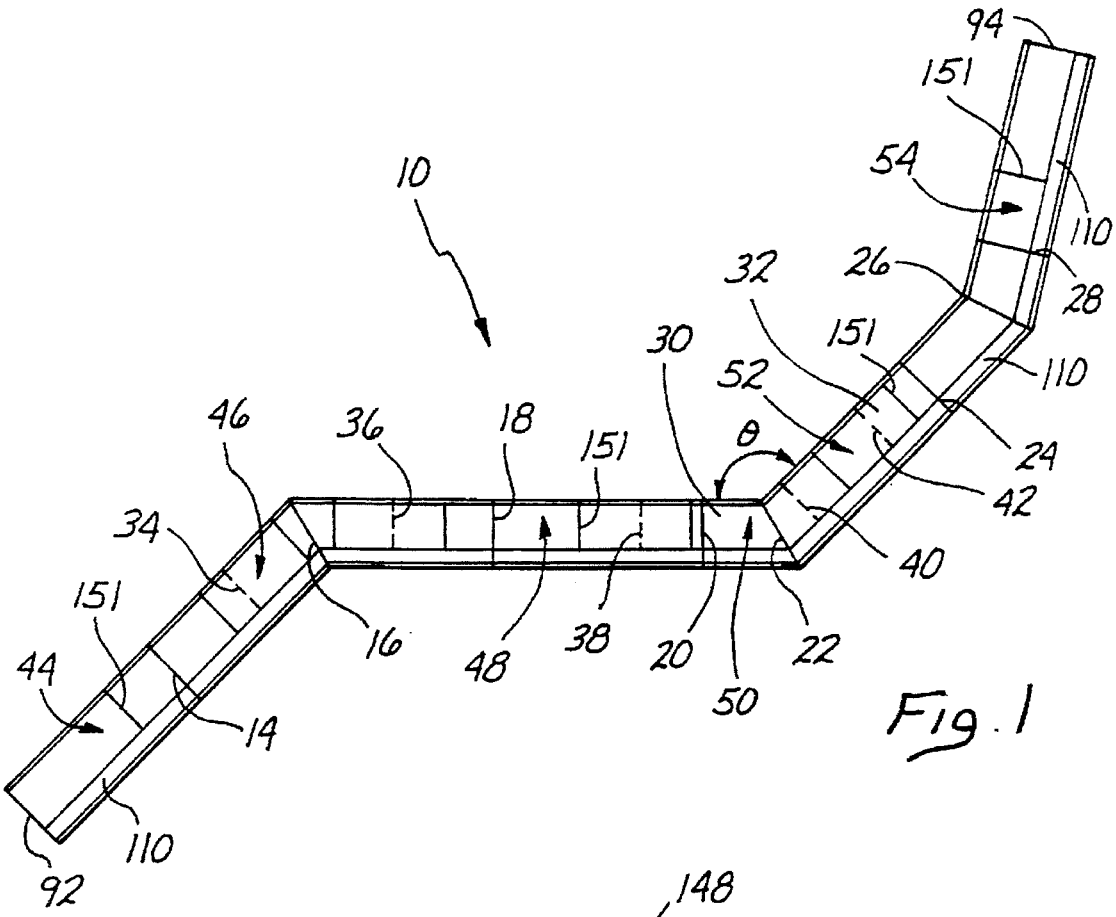
FIG. 1 is a top diagrammatic view illustrating a display case arrangement constructed of a plurality of modular bed sections and embodying the concepts of the invention.

Now with reference to FIG. 1, there is shown diagrammatically a modular display case 10 which is customized from a basic display case design and preferably adapted to display food in a supermarket, delicatessen, or similar setting. Depending upon the particular application, the customized display case 10 may be configured to display any type or combination of types of food, including hot prepared food (such as fried chicken or pizza), cold food (such as delicatessen meats and cheeses), and ambient temperature, or "dry" food (such as breads, pastries, and other bakery items).

The customized display case 10 comprises one or more bed or pan sections 12 (FIGS. 2–5 and 7), which are pre-manufactured to a standard size (118 inches in length, in the preferred embodiment), and then attached end to end in various configurations in order to customize the display case 10 for a particular application. The joints between adjacent bed sections are shown in FIG. 1 at 14, 16, 18, 20, 22, 24, 26, and 28. When adjacent bed sections 12 are attached, the joint is sealed in a known manner, such as by means of a metal strip bridging the two bed sections, to which is applied a sealant material.

A particularly important advantage of the invention is its ability to be easily customized to a particular application. On the other hand, the prior art has heretofore been limited to the arrangement of discrete, self-contained food display cases in an end-to-end fashion. Obviously, using the prior art method there is no flexibility in adjusting the ratio of hot display area to cold display area, for example, beyond changing the number of hot and cold cases employed, and it is virtually impossible to configure the display cases to turn corners in a graceful and pleasing manner. However, utilizing the principles of the invention, it is possible to easily and routinely configure the display case in a supermarket or similar establishment to virtually any arrangement imaginable, thereby making maximum use of the available space, presenting a pleasing aesthetic appearance, and ensuring that each type of display space is available in precisely the quantity dictated by the establishment's product mix and promotional goals.

In order to realize the above described advantage, one facet of the invention is that the modular bed sections 12 are preferably manufactured of a lightweight composite material core, such as urethane foam, bounded by a sheet metal skin, preferably comprising stainless steel and galvanized steel. The core foam provides insulative properties, while the sheet metal skin provides structural strength and rigidity which substantially eliminates the need for longitudinal support elements. Of course, other materials could be used, but the composite materials available today offer weight and strength characteristics which are difficult to duplicate in other more conventional materials. The sheet metal skin is used because it can be easily cleaned and because it presents a sleek and pleasing appearance. Although the bed sections are pre-manufactured to a standard length, they are easily cut, either in a factory or even on site during installation, to other lengths suitable to create a custom installation. For example, if the standard bed length is 118 inches, and a customer desires a 140 inch display case, a first full standard length bed section might be mated with a second bed section which has been cut to a length of 22 inches. In particular, to enable the display case to turn an angle θ (e.g. 45 degrees), as shown in FIG. 1, a first bed section 30 between bed joints 20 and 22 might be cut on one end at an angle of 22.5 degrees, while a second bed section 32 between bed joints 22 and 24 might be cut on its opposite end at an opposing angle of 22.5 degrees, so that the two bed sections, when joined, form an angle θ of 45 degrees therebetween. Alternatively, however, pre-made corner blanks can be used to turn standard angle corners, eliminating some cutting costs and waste of materials.

Another facet of the invention contributing to its modularity is that, unlike the prior art, the bed joints and the boundaries dividing the different temperature display compartments or zones need not coincide. Again referring to FIG. 1, the dashed lines 34, 36, 38, 40, and 42 shown therein represent partitions which serve to divide the display case 10 into different temperature-controlled zones or compartments, i.e. hot, cold, or dry (ambient temperature—it should be noted that ambient temperature zones are considered "controlled" in the sense that their temperature is controlled by the temperature of the surrounding environment). In any given arrangement there is at least one zone, which may be of any type, i.e. hot, cold, or dry. If there are a plurality of zones, one, two, or all three types of zones may be present, in any combination and arrangement, and each zone may be of any desired length. For example, one particular application may be entirely comprised of hot display space, while another application may be comprised of two hot zones sandwiching a dry zone (which may be either an open counter or an enclosed case), followed again by a hot zone and then a long cold zone. In the embodiment shown in FIG. 1, which is purely illustrative, the zone 44 to the left of partition 34 may comprise a hot display area. The zone 46 between partitions 34 and 36 may comprise a dry display area, while the zone 48 between the partitions 36 and 38 may comprise a cold delicatessen or freezer section. The remaining zones 50, 52, and 54 may comprise hot, cold, and dry display regions, respectively. The important thing to note, however, is not the particular configuration illustrated in FIG. 1, but rather the nearly infinite number of possible combinations of zones, and the fact that there is no requirement that any of the partitions positionally coincide with any of the bed joints (though, of course, they may coincide). Each temperature-controlled zone may be of any desired length, and any number of temperature zones may be located on a single bed section, if desired.

Figure 2:
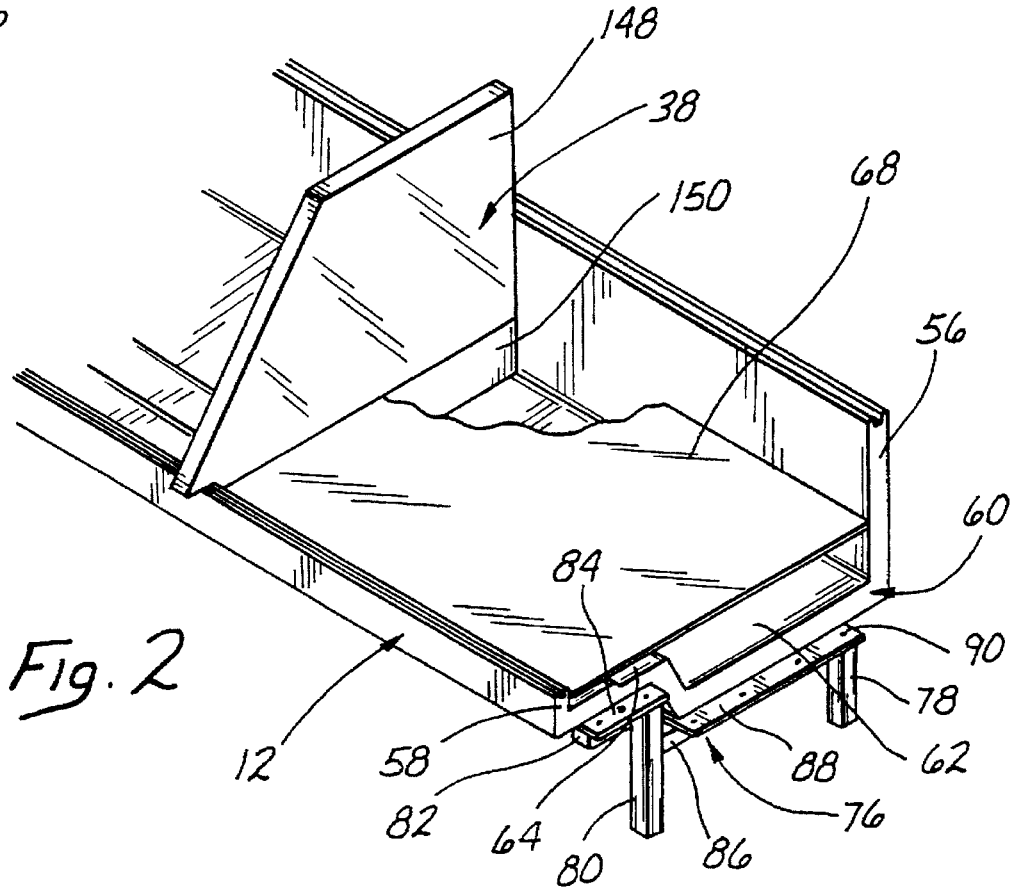
FIG. 2 is a perspective view of a portion of a display case bed section shown in FIG. 1 and constructed in accordance with the teachings of the invention, illustrating the support structure for the bed section and a partition used to divide the bed section into different compartments.
Figure 7:
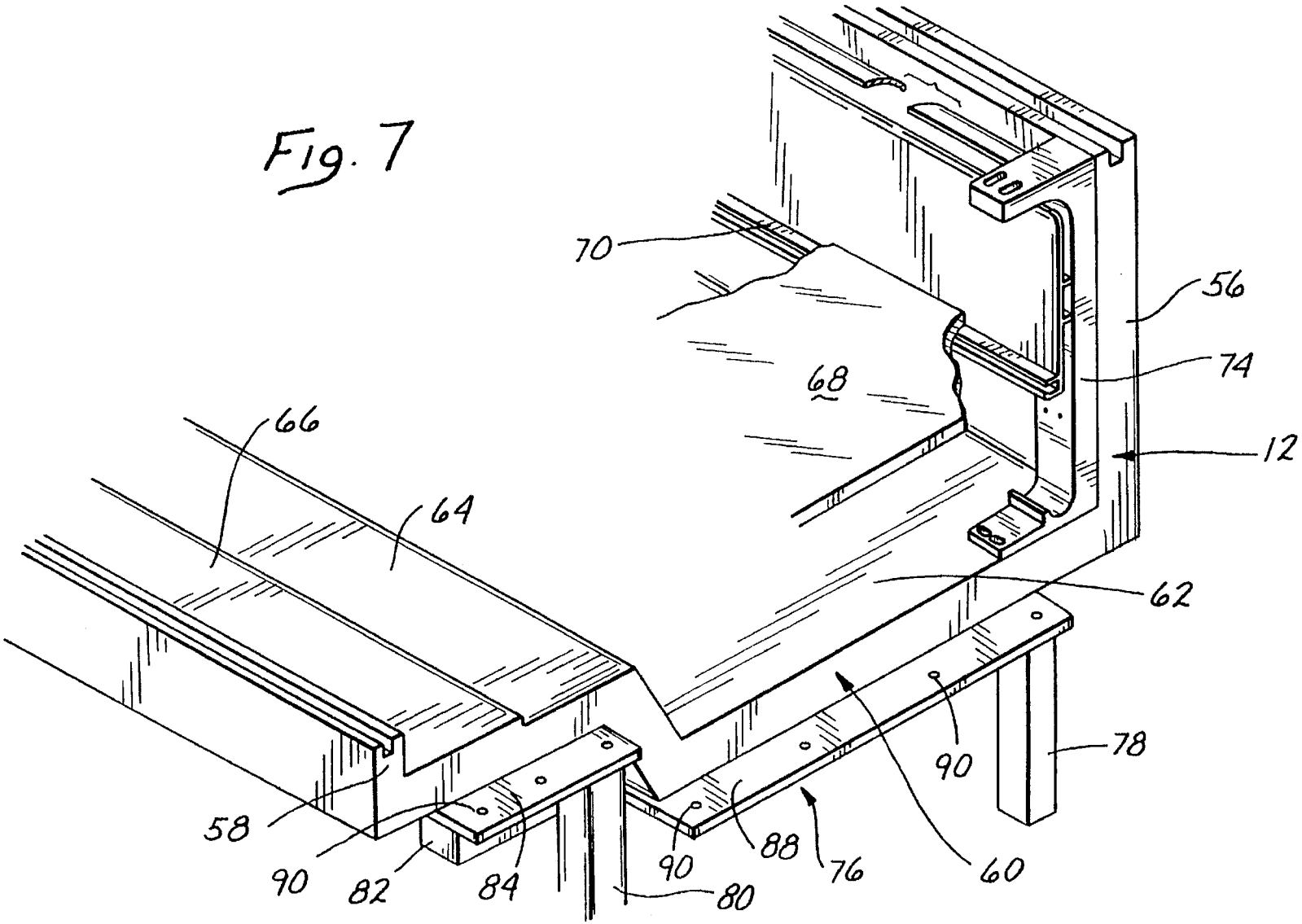
FIG. 7 is an enlarged fragmentary perspective view of the display case shown in FIG. 1, illustrating additional structural features of the invention.

Referring now to FIGS. 2 and 7, the modular bed or pan section 12 comprises a rearward upstanding wall 56 and a forward upstanding wall 58, which together enclose a stepped bed floor 60. The floor 60 includes a first deeper floor portion 62 which steps up to a second shallower floor portion 64 (best seen in FIG. 7). Yet a third floor portion 66 is slightly stepped up from the second floor portion 64 in the preferred embodiment, for a purpose which will be described more fully hereinbelow. Of course, the bed section 12 could be constructed in many other configurations, depending upon considerations related to the design of the basic display case as a whole. The critical feature is that, whatever the bed design, it is standardized so that customized display cases may be readily constructed using the modular, premanufactured beds as basic building blocks. The bed sections 12 underlie all three types of temperature zones (i.e. hot, cold, and dry).

Figure 4:
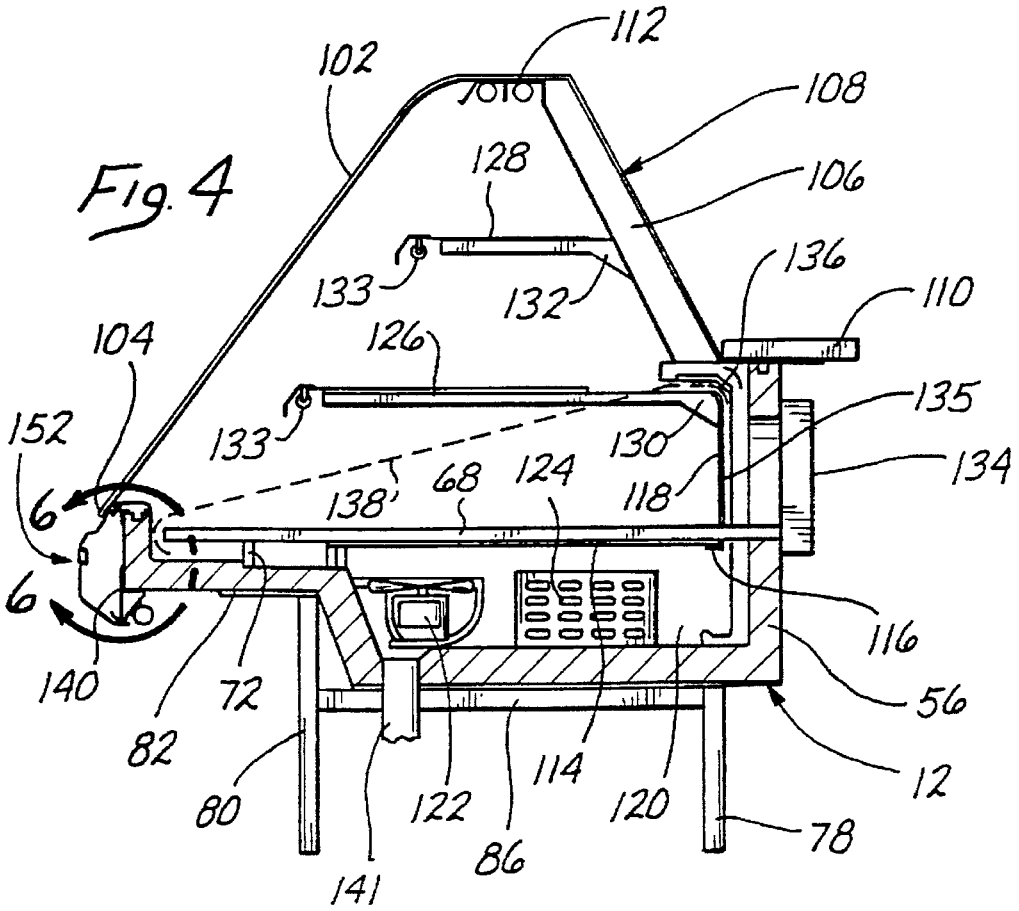
FIG. 4 is a cross-sectional view similar to FIG. 3 taken across the width of a cold compartment portion of the inventive display case arrangement.

Spaced above the bed floor 60 is a deck pan 68, which is supported at its rearward edge by a lengthwise support flange or channel 70 (FIG. 7) and at its forward edge by feet 72 (FIG. 4). Only one foot 72 is illustrated, but any number of feet may be employed, preferably at spaced intervals along the length of the display case bed. In the preferred embodiment, two feet 72 are utilized per deck pan 68. The feet rest upon the second floor portion 64, abutting against the elevated third portion 66, which serves as a stop for the feet, thereby assisting the positioning and stability of the deck pan.

The flange or channel 70 is supported axially along the rearward upstanding wall 56, either by attachment at each end to a support casting 74 or by other means. The deck pan 68 is an optional element which may be utilized, for example, in the cold zone portions of the display case to hide the cooling equipment and support the displayed food. Of course, it also may be used in both the hot and dry zone portions, as well, and is described more fully hereinbelow.

As noted supra, because each bed section 12 is manufactured from lightweight composite materials, no longitudinal support is required for most applications, and the bed section may be supported entirely by a support frame 76 (see, in particular, FIGS. 2 and 7) at each end thereof. The support frame 76 comprises a rear leg 78 and a front leg 80, both preferably constructed of hollow square steel tubing. Attached by a weldment to the front leg 80 and extending horizontally forwardly therefrom is a first tube member 82, on the upper surface of which is welded a first flat support member 84. The flat support member 84 extends along a substantial portion of the underside of the shallower second and third floor portions 64 and 66 of the bed section 12. Similarly, a second tube member 86 (FIGS. 2, 3, 4, and 5) is welded at each end to the rear and front legs 78 and 80, respectively, so as to extend therebetween, and a second flat member 88 is welded to the upper surface thereof, extending along a substantial portion of the underside of the first bed floor portion 62. Each of the flat support members 84 and 88 are preferably constructed of steel bar material and have two parallel rows of spaced fastener holes 90 (FIGS. 2 and 7) arranged therein (only one row of which is visible in the drawing).

Thus, when assembling the display case 10 illustrated in FIG. 1, a support frame 76 may be positioned at the location of each bed joint 14, 16, 18, 20, 22, 24, 26, and 28, as well as at first and second ends 92 and 94, respectively, of the display case 10. Then, at each bed joint, the two adjacent bed sections 12 may be conjoined by bolting each bed section end to one of the two parallel rows of fastener holes 90. As illustrated in FIG. 7, one bed section 12 has already been bolted to the row of holes 90 which is not shown, and the adjacent bed section 12 may be bolted to the visible row of holes. The fastener hole rows are spaced so that when both adjacent bed sections have been bolted to their respective hole row, their opposed ends are aligned and flush with one another to produce a substantially seamless joint. At either end of the display case, since only one bed section 12 is mounted to the support frame 76 located thereat, the bed section is positioned to fully cover the frame top surface, and is bolted to the second row of fastener holes rather than the first one. This arrangement is more aesthetically pleasing, and also provides better support to the display case at each end. Of course, other means for supporting the modular beds could be employed, and it may, under certain conditions, be preferable to interlock the bed sections together.

Figure 3:
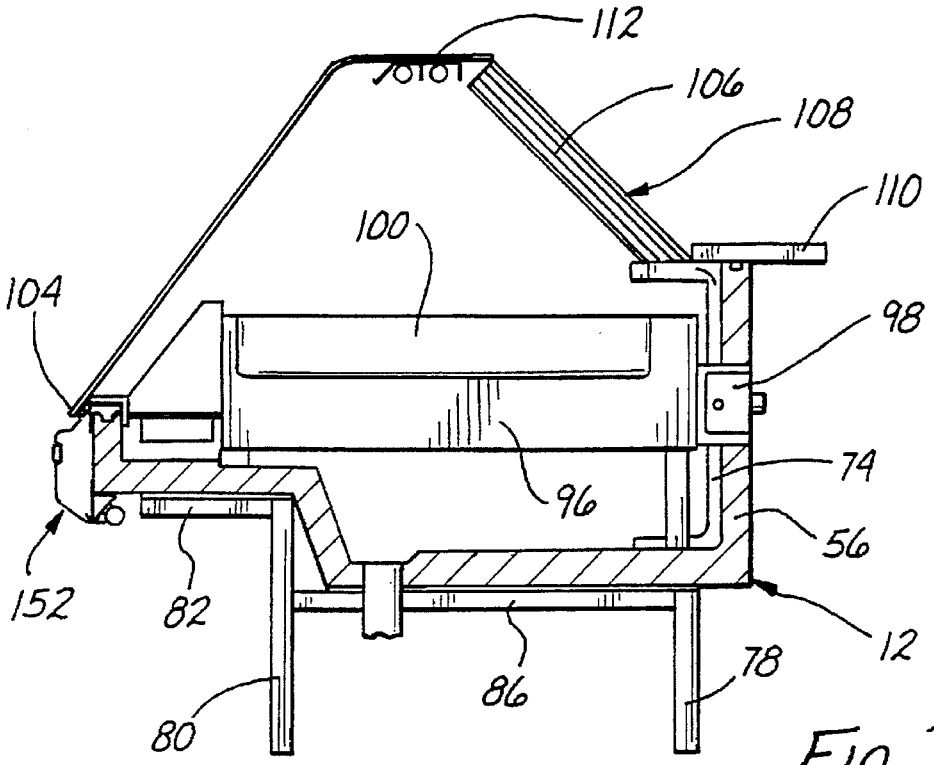
FIG. 3 is a cross-sectional view taken across the width of a hot compartment portion of the inventive display case arrangement shown in FIG. 1.

Referring now more particularly to FIG. 3, there is illustrated a cross-sectional view of a preferred embodiment of a hot compartment zone, which may, for example, comprise either zone 44 or 50 of the display case 10 shown in FIG. 1. More specifically, the hot compartment zones each comprise at least a portion of one modular bed section 12, within which is preferably supported a warming pan 96. The warming pan 96 is of a conventional type, typically being constructed of stainless steel or the like. A heater (not shown) is employed to heat the pan 96. In the preferred embodiment, a convection heater is employed, but alternatively, the pan 96 could include a reservoir for containing water, with an immersion heater within the reservoir for heating the water. The heater is controlled by suitable means, such as a controller 98, so that the food is kept at an appropriate temperature. A top surface 100 receives the food to be displayed.

Enclosing the hot zone of the display case 10, and further ensuring the maintenance of a desired temperature therein, is a front glass 102. The glass is fashioned in a suitably aesthetic manner and is preferably hinged at the top so that it may be lifted from the bottom 104 upwardly in order to provide convenient access to the interior of the hot compartment. A gas strut 106, or the like, may be employed to provide assistance in lifting the front glass 102, and in maintaining the front glass in an open position. The gas strut 106, in turn, is supported by the casting 74, as shown, and forms a part of a wall member 108 which bridges the rearward upstanding wall 56 and the front glass 102 to complete the enclosure of the hot zone. Atop the rearward upstanding wall 56 is preferably positioned a work shelf 110, which may, if desired, span substantially the entire length of the display case 10 (see FIG. 1). An upper light bar 112 is preferably provided to supply light to the interior of the display area.

FIG. 4 is a cross-sectional view of a preferred embodiment of a cold compartment zone, which may, for example, comprise either 48 or 52 of the display case 10 shown in FIG. 1, wherein like elements with respect to FIG. 3 are designated with like reference numerals. The cold compartment zones each comprise at least a portion of one modular bed section 12, within which is preferably supported a deck pan 68, as shown in FIGS. 2 and 7. Directly beneath the deck pan 68 lies a fan cover 114, which is attached by means of a hinge 116 to a baffle plate 118. Beneath the fan cover 114 is a coil space 120, within which is arranged an axial fan 122 and a refrigeration coil 124. The coil 124 may be of any available length, depending upon the length of the particular cold compartment zone, and along the length of the display case 10, different length coils 124 may be employed in different cold zones, if desired. For example, in the display case 10 shown in FIG. 1, the coil 124 in zone 48 may be of a different length than the coil 124 in the zone 52. The fan 122 and coil 124 may be mounted on the bed floor, as shown, or alternatively may be attached to the fan cover 114.

In one preferred embodiment of the invention, food may be displayed on the deck pan 68, as well as on first and second tiered shelves 126 and 128, respectively. The shelf 126 is spacedly mounted from the casting 74 by means of a first bracket arrangement 130, while the shelf 128 is similarly mounted from the wall member 108 by means of a second bracket arrangement 132. Of course, any number and arrangement of shelves may be employed, and they may be mounted in any known fashion. Alternatively, only the deck pan 68 may be employed. If desired, light bars 133 may be mounted on each shelf 126, 128, to improve the lighting in the display area. A drawer pull 134 may be employed to afford easy access to the display compartment from the rear.

Refrigerated air is circulated through the cold zone in order to maintain a substantially uniform temperature throughout. The air circulates from the fan 122 through the coil 124, where it is cooled, then flows upwardly through a standoff passage 135 between the baffle plate 118 and the rearward upstanding wall 56. An important feature of the invention is that, adjacent to the top of the baffle plate 118, within the passage 134, is a deflector 136, which comprises one or more turning vanes. The deflector 136 preferably functions to direct the air flowing upwardly through the passage 134 out into the display area, with a downward component such that the air generally follows a dashed path 138 to the inlet of a return passage 140, through which it is returned beneath the deck pan 68 to the fan 122. Thus, since the cooled air does not directly impact the front glass 102, fogging of the glass because of condensation, a significant problem in the prior art, is minimized. Water condensing from the coil 124 and accumulating in the coil space 120 drains from the water drain 141.

Figure 5:
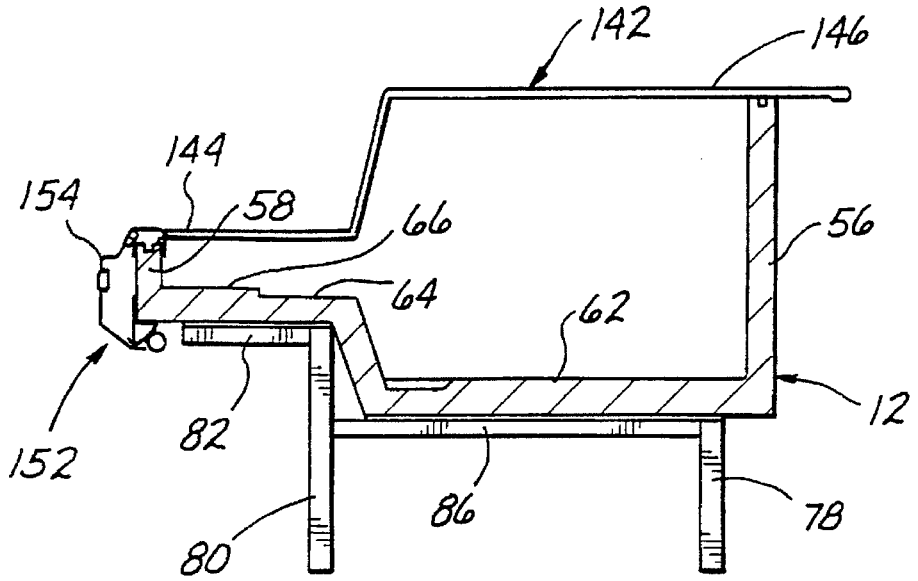
FIG. 5 is a cross-sectional view similar to FIG. 3 taken across the width of an ambient temperature (dry) compartment portion of the inventive display case arrangement.

Now with reference to FIG. 5, there is shown a cross-sectional view of a preferred embodiment of a dry compartment zone, which may, for example, comprise either 46 or 54 of the display case 10 shown in FIG. 1, wherein like elements with respect to FIGS. 3 and 4 are designated with like reference numerals. Similar to the cold and hot compartment zones, each of the dry compartment zones comprise at least a portion of one modular bed section 12. A counter 142 is supported by feet (not shown) which rest on the floor 60 of the bed section 12, and may be used to display food or other items which can be stored at ambient (room) temperature, such as bread, rolls, and other bakery items. In the illustrated embodiment, the counter 142 comprises a forward lower counter portion 144 and a rearward higher counter portion 146, but in actuality any desired counter configuration may be employed, and it is understood that the counter may also be utilized with or without the front glass 102 (FIG. 4). In some instances, it may be desirable to utilize a deck pan 68 like that shown in FIG. 4, and perhaps a fan 122 without the coils 124, so that ambient temperature air may be circulated through the dry compartment, and such an arrangement is within the scope of the invention.

As discussed supra, a critical feature of the invention is the ability to partition the display case 10 at locations other than the bed joints 14, 16, 18, 20, 22, 24, 26, and 28 (FIG. 1), so that the case 10 may be customized to provide different compartments according to a particular desired configuration. This partitioning is accomplished by use of modular partitions such as those shown for exemplary purposes at 34, 36, 38, 40, and 42 in FIG. 1. A representative partition 38 is illustrated in greater detail in FIG. 2. While the particular construction of the partition 38 may vary, it is preferred that it be of a two piece construction, with a glass portion 148 and an air block portion 150, preferably constructed of plastic. Of course, the glass portion 148 is configured to conform to the contour of the front glass 102 as well as the bed section 12, above the deck pan 68, in order to ensure that there is a seal which retards air movement between two adjacent display compartments, while the air block portion 150 is similarly configured to conform to the bed section configuration below the deck pan 68. Depending upon the relative temperature difference between two adjacent zones, the glass portion 148 may be constructed of single pane glass, preferably ⅜ inches thick, or alternatively multipane glass, in order to provide greater insulative properties.

Another significant advantage of the disclosed invention is its sleek and aesthetically pleasing appearance, which is an important attribute in the highly competitive retail food business. The appearance of the display case 10 is enhanced, of course, because of its continuous layout, as opposed to the use of discrete modules, which permit its configuration to be customized and to smoothly round corners, as discussed supra. The contoured appearance of the front glass 102, which is preferably supplied by Sovis, a manufacturer headquartered in France, also improves the visual impact of the case 10. The front glass 102 may be supplied in a standard length (2 meters in the preferred embodiment), and may be cut to a shorter length to fit a particular installation, and it may also be customized to turn a corner, similar to the modular beds 12. The glass sections may be attached end-to-end in a known fashion. Importantly, as with the beds 12, the joints 151 (FIG. 1) between attached sections need not positionally coincide with the partitions between display zones, or with the bed joints.

Yet a third feature which materially enhances the case's appearance is a front panel structure 152 (FIGS. 3–6). The front panel structure 152 is designed to cover the forward upstanding wall 58 of each successive bed section 12 in a substantially seamless fashion along the length of the case 10, thus creating a continuous presentation front. Because of its unique design, it may be retained without the need for any fastening hardware.

Figure 6:
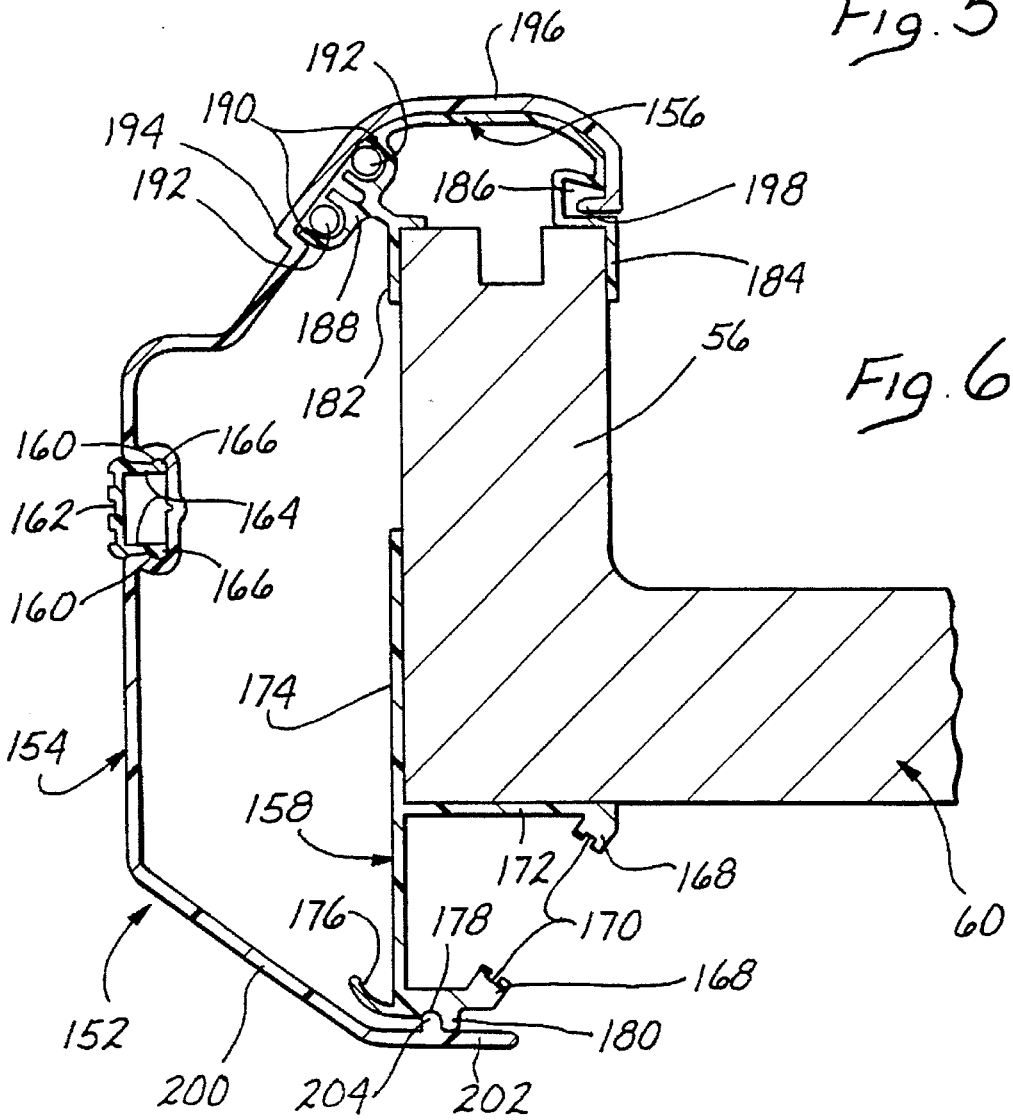
FIG. 6 is an enlarged cross-sectional view of the front panel structure delineated by lines 6—6 of FIG. 4.

Referring now more particularly to FIG. 6, which is an enlarged cross-sectional view of the region delineated by the arrows 6—6 of FIG. 4, it may be seen that the front panel 152 comprises a front profile strip 154, a first rail or heat rail 156, and a second rail or lower light rail 158. The front profile strip 154 is preferably formed of anodized, extruded aluminum which is cut to length. Fitted joints are employed to attach a plurality of strips in an endwise fashion so that the strip may run the entire length of the display case 10. The front profile strip 154 includes a recess 160 which is adapted to receive a color band 162. The color band, which is decorative and may be of any desired color, preferably comprises a thick aluminum extrusion and includes means for integrally locking itself into the recess 160 without fastening hardware. For example, in the illustrated preferred embodiment, the color band 162 includes a pair of legs 164 having flanged ends 166 which interlock into corresponding grooves within the recess 160. Alternatively, a similarly constructed bumper may be employed, which comprises a rubber strip designed to prevent damage to the case 10 from shopping cart impacts.

The lower light rail 158 serves to provide a lower attachment point for the profile strip 154, and may also serve a second purpose of receiving a light strip for providing illumination beneath the bed 12 of the display case 10. The rail 158 comprises a pair of light strip receiving flanges 168 which include slots 170 adapted to receive opposing ends of a light strip. The rail 158 further comprises first and second perpendicularly oriented mounting surfaces 172 and 174, which are adapted to be mounted to the stepped bed floor 60 and the forward upstanding wall 58 of each bed section 12, respectively. Each mounting surface 172 and 174 is preferably attached to the bed section 12 by means of bolts, but could otherwise be attached by any known attachment method, such as by adhesives. The lower light rail 158 also comprises a ski ramp 176, a receiving groove 178, and a stop 180, the purpose of which will become apparent hereinbelow.

The heat rail 156 comprises first and second mounting brackets 182 and 184, respectively, which may be attached to the upper surface of the forward upstanding wall 58 by means of bolts or equivalent fastening means, such as screws or adhesive. Essentially, the heat rail forms a cap which encloses the upper surface of the wall 58. On its rearward side, a receiving recess 186 is provided, for a purpose which will become apparent hereinbelow. On its forward side, a strip heater supporting structure 188 is provided, on which a pair of channels 190 are adapted to each receive a strip heater 192. The strip heaters 192, which are optional, function to heat the front glass 102 to prevent any fogging which is not prevented by the deflector 136. Of course, inmost installations the strip heaters are not employed along the entire length of the case 10, since they are not necessary along portions which do not have a front glass 102, or which do not have refrigerated air.

The heat rail 156 and the lower light rail 158 together function as mounting attachment points for the front profile strip 154. The front profile strip 154 is configured robe aesthetically pleasing, but also has functional elements. For example, at its upper end, it includes a stepped portion 194, permitting the profile strip to cover the strip heater supporting structure 188. Above the stepped portion 194 is a curved region 196 which substantially envelops the heat rail 156 in closely spaced relation thereto. At its upper end, the front profile strip 154 includes an attachment flange 198, which is adapted to be received in the recess 186.

At its opposing lower end, the profile strip 154 comprises an angled portion 200, which culminates in an end portion 202 having a projection 204. The projection 204 is adapted to be received by the groove 178.

To assemble the front panel structure 152, the heat rail 156 and the lower light rail 158 are first bolted or otherwise fastened onto the bed 12, in the manner described hereinabove. Then, the upper and lower ends of the front profile strip 154 may be attached to the heat rail 156 and the lower light rail 158, respectively, without the use of any fastening hardware such as screws, bolts, or the like, to thereby mount the front profile strip in position. To complete the attachment, the curved region 196 of the front profile strip 154 is fitted over the heat rail 156, and the attachment flange 198 is snapped into the receiving recess 186. In the meantime, the lower end of the strip 154 is positioned so that the projection 204 is received by the groove 178 and is in an abutting relationship with the stop 180. The ski ramp 176 may function to guide the projection 204 into proper position.

Although an exemplary embodiment of the invention has been shown and described, many changes, modifications, and substitutions may be made by one having ordinary skill in the art without necessarily departing from the spirit and scope of this invention. Accordingly, it is intended that the invention be limited only by the scope of the claims set forth hereinbelow.

What is claimed is:

1. A modular case for displaying food or the like, comprising:

a bed section having a first length and having first and second ends;

a first zone having a variable second length;

a second zone having a variable third length, said first and second zones being arranged serially along a longitudinal axis of said bed section and being adapted for maintenance at substantially different temperatures relative to one another said different temperatures maintained constant regardless of the actual size of said variable lengths by providing each said zone with independent temperature control; and a partition located in said case for dividing said first and second zones;

wherein said partition may be positioned at a location along the length of said bed section axially spaced from said first and second ends, and is adapted to be movable when modification of said second or third lengths is desired.

2. A modular case as recited in claim 1, said case comprising a plurality of said bed sections arranged serially end to end, such that a first end of one bed section abuts a second end of an adjacent bed section at a bed joint, wherein said partition may be positioned at a location axially spaced from said bed joint.

3. A modular case as recited in claim 2, wherein the length of at least one of said bed sections is different than the length of another of said bed sections.

4. A modular case as recited in claim 2, wherein adjoining ends of two adjacent bed sections are cut at predetermined opposing angles to form an angular portion of said case, the degree of angularity of said angular portion being directly related to the size of the predetermined opposing angles.

5. A modular case as recited in claim 2, including a premanufactured corner blank bed section having a predetermined angularity which is interposed between two adjacent bed sections to form an angular portion of said case.

6. A modular case as recited in claim 1, said case comprising a plurality of said bed sections arranged serially end-to-end, such that a first end of one bed section abuts a second end of an adjacent bed section at a bed joint, each of said first and second zones comprising a hot zone, a cold zone, or a room temperature zone.

7. A modular case as recited in claim 6, wherein each of said bed sections comprise a bed floor, a first upstanding wall, and a second upstanding wall, said cold zone further comprising a deck pan elevated a predetermined distance above said bed floor and supported by said first and second walls, such that a space is defined between said deck pan and said bed floor and said deck pan defines a floor of said cold zone upon which items to be displayed may be placed, a front glass enclosing said cold display zone, said space having an air inlet passage located at a forward end thereof and an air outlet passage located at a rearward end thereof, said air outlet passage including at least one deflector vane therein, a fan and a refrigeration coil being located in said space, such that when said fan is actuated, air flows from the fan through the coil, then exits said space through said outlet passage into the cold zone display area, said air being deflected forwardly by said at least one deflector vane across said display zone and back into the coil space through said inlet passage without substantially impacting said front glass, thereby minimizing fogging of the front glass.

8. A modular case as recited in claim 1, wherein said bed section is constructed of a lightweight composite material and further comprises a support structure, including a support frame at each end of the bed section and a pair of legs attached to each support frame, said support structure including substantially no longitudinally oriented members.

9. A modular case as recited in claim 6, said case further comprising a plurality of front glass sections for enclosing said first and second zones, said front glass sections being arranged serially end-to-end such that a first end of one glass section abuts a second end of an adjacent glass section at a front glass joint, wherein the boundaries and lengths of each of said zones are also determined independently of the location of each said glass joint.

10. A modular case for displaying food or the like, comprising:

a plurality of temperature-controlled compartments; and a plurality of partitions dividing and substantially sealing said compartments;

wherein said compartments have varying lengths, according to design considerations related to the needs of a particular application, and said partitions are movable to change the respective lengths of each compartment either during or after installation of the case, the temperature of said compartments remaining constant regardless of the actual size of the varying lengths.

11. A modular case as recited in claim 10, wherein said case has a longitudinal axis and further comprises a plurality of modular bed sections, said bed sections being arranged serially end to end along said longitudinal axis, such that a first end of one bed section abuts a second end of an adjacent bed section at a bed joint, wherein said partitions need not be co-located with said bed joints, but rather may be located anywhere along the length of said case.

12. A modular case as recited in claim 10, wherein said case includes a plurality of refrigeration compartments having variant lengths with respect to one another, each of said refrigeration compartments including a refrigeration coil oriented along substantially the entire length of said compartment, such that the compartment is cooled as uniformly as possible, whereby the plurality of coils employed in said case also have variant lengths with respect to one another.

13. A modular case as recited in claim 10, said case further comprising a support structure including a support frame and a plurality of legs, and further including a front panel structure for covering said support structure with a substantially continuous facade, said front panel structure comprising a front profile strip which is adapted to be arranged longitudinally along substantially the entire length of the case, said strip being attached to said support structure without the use of separate fastening hardware.

14. A modular case as recited in claim 13, wherein said bed section further comprises a bed floor, a first upstanding forward wall, and a second upstanding rearward wall and said front panel structure further comprises a first rail and a second rail, said first rail being attached to said forward upstanding wall at an upper end thereof, and said second rail being attached to said wall at a lower end thereof, said front profile strip comprising engaging elements which correspond to receiving elements on said first rail and said second rail, respectively, for attaching an upper end of said strip to said first rail and a lower end of said strip to said second rail by interengagement of said engaging elements with said receiving elements.

15. A modular case as recited in claim 11, wherein said bed section further comprises a bed floor, a first upstanding forward wall, and a second upstanding rearward wall, said bed floor comprising a first rearward lower floor portion and a second forward higher floor portion.

16. A modular case as recited in claim 15, and further comprising a deck pan supported robe elevated a predetermined distance above said bed floor, such that a space is defined between said deck pan and said bed floor and said deck pan defines a floor of one of said temperature-controlled compartments upon which items to be displayed may be placed, said bed section being adapted to receive a front glass for enclosing said temperature-controlled compartment.

17. A modular case as recited in claim 16, wherein the deck pan is supported by a plurality of foot members which rest upon the second floor portion, said bed floor further comprising a third floor portion which is forward of and stepped upwardly with respect to said second floor portion, such that said foot members are adapted to abut said third floor portion when the deck pan is in its supported position, the third floor portion thereby functioning as a stop.

18. A modular case as recited in claim 11, said bed section further comprising a support structure including a first support frame corresponding to said first end and a second support frame corresponding to said second end, each said support frame comprising a rear leg and a front leg and having a first tube member attached to said front leg and extending horizontally forwardly therefrom, and a second tube member attached to said rear leg at one end and to said front leg at its other end, so as to extend therebetween, said first tube member having a first flat support member attached thereatop, and said second tube member having a second flat support member attached thereatop, wherein each end of said bed section is attached to the first and second flat support members corresponding thereto.

19. A modular bed section adapted for use in constructing a display case having a plurality of temperature-controlled zones, said bed section having a first end and a second end and being pre-manufactured to a predetermined standard length, and being adapted for combination with other similar bed sections to construct said case by attaching the bed sections in an end-to-end fashion along a longitudinal axis thereof.

20. A modular bed section as recited in claim 19, and further comprising a bed floor, a first upstanding forward wall, and a second upstanding rearward wall, said bed floor comprising a first rearward lower floor portion and a second forward higher floor portion.

21. A modular bed section as recited in claim 20, and further comprising a deck pan supported to be elevated a predetermined distance above said bed floor, such that a space is defined between said deck pan and said bed floor and said deck pan defines a floor of one of said temperature-controlled zones upon which items to be displayed may be placed, said bed section being adapted to receive a front glass for enclosing said temperature-controlled zone.

22. A modular bed section as recited in claim 21, wherein said deck pan is supported by a plurality of foot members which rest upon the second floor portion, said bed floor further comprising a third floor portion which is forward of and stepped upwardly with respect to said second floor portion, such that said foot members are adapted to abut said third floor portion when the deck pan is in its supported position, the third floor portion thereby functioning as a stop.

23. A modular bed section as recited in claim 19, said bed section further comprising a support structure including a first support frame corresponding to said first end and a second support frame corresponding to said second end, each said support frame comprising a rear leg and a front leg and having a first tube member attached to said front leg and extending horizontally forwardly therefrom, and a second tube member attached to said rear leg at one end and to said front leg at its other end, so as to extend therebetween, said first tube member having a first flat support member attached thereatop, and said second tube member having a second flat support member attached thereatop, wherein each end of said bed section is attached to the first and second flat support members corresponding thereto.

24. A method of assembling a case for displaying food or the like, and having a plurality of temperature-controlled zones, the case including a plurality of pre-manufactured modular bed sections, the method comprising the steps of:

a) determining the desired length of the case and procuring a sufficient number of said modular bed sections;

b) attaching said modular bed sections in an endwise fashion;

c) providing structure to support said bed sections; and d) positioning one or more partitions in said case to divide said plurality of temperature-controlled zones, said partitions being located anywhere along the length of said case to customize the length of each zone as desired while maintaining a constant temperature in each zone regardless of its actual length.

25. A method as recited in claim 24, wherein step a) includes the step of cutting the length of one or more of said modular bed sections in order to obtain a desired overall case length.

26. A method as recited in claim 24, wherein step a) includes the step of cutting each of the adjoining ends of two adjacent bed sections at predetermined opposing angles, so that when said two bed sections are attached in step b), the opposing angles create an angular portion of the case, said angular portion having a degree of angularity equal to the sum of the two opposing angles.

27. A method as recited in claim 24, wherein step a) includes the step of obtaining a prefabricated corner blank bed section having a desired degree of angularity and step b) includes the step of inserting said corner blank bed section between two adjacent linear bed sections during the attachment of said bed sections in an endwise fashion, thereby creating an angular section of the case at a desired point along its length.

28. A method of changing the configuration of a case for displaying food or the like, and having a plurality of temperature-controlled compartments, the case including a plurality of modular bed sections which are attached in an endwise fashion to form a desired case configuration, and one or more partitions to divide said plurality of temperature-controlled compartments, the method comprising the steps of:

a) rearranging said plurality of bed sections to create a new desired case configuration; and b) moving one or more of said partitions to create a new arrangement of temperature-controlled compartments, wherein the movement of said partitions may be completed without regard to the location of the joints between said bed sections.

29. A method as recited in claim 28, wherein step a) includes the step of cutting the length of one or more of said bed sections in order to obtain the new desired case configuration.

* * * * *